US010765150B2

(12) United States Patent
Qiu

(10) Patent No.: US 10,765,150 B2
(45) Date of Patent: Sep. 8, 2020

(54) ATOMIZER AND ELECTRONIC CIGARETTE USING THE SAME

(71) Applicant: CHANGZHOU JWEI INTELLIGENT TECHNOLOGY CO., LTD., Changzhou (CN)

(72) Inventor: Weihua Qiu, Changzhou (CN)

(73) Assignee: CHANGZHOU JWEI INTELLIGENT TECHNOLOGY CO., LTD., Changzhou (CN)

( * ) Notice: Subject to any disclaimer, the term of this patent is extended or adjusted under 35 U.S.C. 154(b) by 327 days.

(21) Appl. No.: 15/952,139

(22) Filed: Apr. 12, 2018

(65) Prior Publication Data

US 2018/0228219 A1 Aug. 16, 2018

Related U.S. Application Data

(63) Continuation of application No. PCT/CN2016/101670, filed on Oct. 10, 2016.

(30) Foreign Application Priority Data

Oct. 13, 2015 (CN) ..... 2015 1 0674044
Jan. 6, 2016 (CN) ..... 2016 2 0005261

(51) Int. Cl.
*A24F 47/00* (2020.01)

(52) U.S. Cl.
CPC ..... *A24F 47/008* (2013.01)

(58) Field of Classification Search
CPC ..... A24F 47/008
See application file for complete search history.

(56) References Cited

U.S. PATENT DOCUMENTS

2013/0228191 A1* 9/2013 Newton ..... A24F 47/008 131/329
2015/0053216 A1* 2/2015 Liu ..... F22B 1/18 131/329

(Continued)

FOREIGN PATENT DOCUMENTS

CN 203353681 U 12/2013
CN 203986121 U 12/2014

(Continued)

OTHER PUBLICATIONS

The International Search Report of corresponding international PCT Application No. PCT/CN2016/101670, dated Dec. 29, 2016.

(Continued)

*Primary Examiner* — James Harvey
(74) *Attorney, Agent, or Firm* — J.C. Patents

(57) ABSTRACT

An atomizer and an electronic cigarette comprising the atomizer. The atomizer comprises a liquid storage tube (1), a liquid adjustment assembly (2), and an atomization head (5). The liquid adjustment assembly (2) comprises an adjustment ring (21) and a first sleeve (22) sleeved on the periphery of the atomization head (5). The adjustment ring (21) is exposed outside the liquid storage tube (1). The atomization head (5) is provided with a first liquid-inlet (51), and the first sleeve (22) is provided with a second liquid-inlet (221). The adjustment ring (21) and the atomization head (5) are relatively fixedly connected, and through rotation of the adjustment ring (21), the first liquid-inlet (51) is communicated with or staggered from the second liquid-inlet (221). The atomizer enables a user to adjust, at the outside of the atomizer, an inflow amount of cigarette liquid into the atomization head (5).

19 Claims, 19 Drawing Sheets

(56) References Cited

U.S. PATENT DOCUMENTS

| | | | | |
|---|---|---|---|---|
| 2018/0228219 | A1* | 8/2018 | Qiu | A24F 47/008 |
| 2019/0191772 | A1* | 6/2019 | Qiu | A61M 15/06 |
| 2019/0350258 | A1* | 11/2019 | Xiao | A24F 47/008 |

FOREIGN PATENT DOCUMENTS

| | | | |
|---|---|---|---|
| CN | 104382237 | A | 3/2015 |
| CN | 204393353 | U | 6/2015 |
| CN | 204499486 | U | 7/2015 |
| CN | 204519375 | U | 8/2015 |
| CN | 204540844 | U | 8/2015 |
| CN | 204635088 | U | 9/2015 |
| CN | 105192893 | A | 12/2015 |
| CN | 204888732 | U | 12/2015 |
| CN | 205125039 | U | 4/2016 |
| CN | 205321213 | U | 6/2016 |

OTHER PUBLICATIONS

The Chinese First Examination and Search Report of corresponding China patent Application No. 201510674044.7, dated Jul. 24, 2017.

* cited by examiner

ATOMIZER AND ELECTRONIC CIGARETTE USING THE SAME

CROSS-REFERENCE TO RELATED APPLICATIONS

This application is a continuation of International Application No. PCT/CN2016/101670, filed on Oct. 10, 2016, which claims priority to Chinese Patent Application No. 201510674044.7, filed on Oct. 13, 2015 and Chinese Patent Application No. 201620005261.7, filed on Jan. 6, 2016, all of which are hereby incorporated by reference in their entireties.

TECHNICAL FIELD

The present disclosure relates to the electronic cigarette technical field, in particular, to an atomizer and an electronic cigarette using the same.

BACKGROUND

An electronic cigarette atomizes cigarette liquid within the cigarette cartridge to smoke, which can be smoked like traditional cigarettes. For the present liquid-adjustable electronic cigarette, a control end of a cigarette liquid adjusting device is normally set inside an atomizer, which makes the user cannot control the cigarette liquid adjusting device from the outside, and when the liquid inlet amount is adjusted, the atomizer needs to be detached, so that the user can make contact with the control end to adjust the liquid inlet amount. This operation is extremely inconvenient in use, and the cigarette liquid may also flow out in the operation process.

SUMMARY

In view of the technical background described above, it is necessary to provide an atomizer and an electronic cigarette using the same to overcome the above problems.

An atomizer includes a liquid storage tube, a liquid adjustment assembly, and an atomization head, the liquid adjustment assembly includes an adjustment ring and a first sleeve, the first sleeve is sleeved on an outer periphery of the atomization head, the liquid storage tube is sleeved on an outer periphery of the first sleeve, and the adjustment ring is exposed outside the liquid storage tube, the adjustment ring and the liquid storage tube together form an outline of the atomizer, the atomization head is formed with a first liquid inlet, and the first sleeve is formed with a second liquid inlet, the adjustment ring and the atomization head are relatively fixedly connected, so that the first liquid inlet is communicated with/staggered from the second liquid inlet by rotating the adjustment ring; or the adjustment ring and the first sleeve are relatively fixedly connected, so that the second liquid inlet is communicated with/staggered from the first liquid inlet by rotating the adjustment ring.

Further, the adjustment ring is provided with one or more stop through holes, and the adjustment ring and the first sleeve or the atomization head are relatively fixedly connected after each of the stop through holes correspondingly passes through a clamping piece, or the first sleeve is formed with one or more clamping pieces, and after each of the clamping pieces correspondingly passes through one of the stop through holes, the first sleeve and the adjustment ring are relatively fixedly connected.

Further, the liquid adjustment assembly further includes a second sleeve, the second sleeve is sleeved between the first sleeve and the atomization head, or sleeved between the first sleeve and the liquid storage tube, the second sleeve is formed with a third liquid inlet, the adjustment ring and the second liquid inlet are relatively fixedly connected, and the second liquid inlet is communicated with/staggered from the third liquid inlet by rotating the adjustment ring.

Further, the outer periphery of the atomization head is flanged with a chuck, and a clamping groove is correspondingly formed on the adjustment ring, the chuck is clamped into the clamping groove so that the atomization head and the adjustment ring are relatively fixedly connected.

Further, the first sleeve includes a main body plate as well as a connecting end and a liquid storage end which are oppositely formed on plate surfaces of the main body plate at its two sides, the liquid storage end is sleeved on the outer periphery of the atomization head, the second liquid inlet is formed on a peripheral wall of the liquid storage end, the liquid storage tube is sleeved on an outer periphery of the liquid storage end, a space for storing cigarette liquid is formed between an inner peripheral face of the liquid storage tube and an outer peripheral face of the liquid storage end, the connecting end includes the one or more clamping pieces, and the stop through holes with the number equal to that of the clamping pieces are correspondingly formed on the adjustment ring.

Further, the atomizer further includes a liquid injection assembly, the liquid injection assembly includes a liquid injection part and an upper cover, the liquid injection part is installed on an end of the liquid storage tube opposite to the adjustment ring, the liquid injection part is connected to an end of the liquid storage end away from the main body plate, the liquid injection part is formed with a liquid injection hole communicated with the space for storing cigarette liquid, the upper cover covers the liquid injection part, the upper cover is formed with a smoke outlet, and the smoke outlet, the liquid storage end and the inner chamber of the atomization head are communicated to form a smoke channel.

Further, the atomizer further includes a base assembly, wherein the base assembly includes a base, an air adjustment inner ring, an air adjustment ring, a contact electrode and an insulation ring, the air adjustment inner ring is sleeved on an outer periphery of the base, the air adjustment ring is sleeved on an outer periphery of the air adjustment inner ring, the contact electrode is installed in the base, the insulation ring is sleeved on an outer periphery of the contact electrode, the contact electrode is conductively connected with the atomization head, the air adjustment inner ring is formed with a first air inlet, and the air adjustment ring is formed with a second inlet, and the second air inlet is communicated with/staggered from the first air inlet by rotating the air adjustment ring.

Further, the atomizer further includes a liquid injection part, wherein the liquid injection assembly includes a liquid injection part, the liquid injection part is installed on a top end of the liquid storage tube, a top end of the first sleeve is formed with the one or more clamping pieces, the liquid injection part is correspondingly formed with the stop through holes with the number equal to the number of the clamping pieces, and the clamping pieces and the adjustment ring are relatively fixedly connected after passing through the corresponding stop through holes.

Further, the second sleeve is sleeved between the first sleeve and the atomization head, a top end of the second sleeve and the liquid injection part are fixedly connected, a space between the liquid storage tube and the first sleeve is a liquid storage chamber used for holding cigarette liquid, and the stop through holes are communicated with the liquid storage chamber.

Further, the liquid injection part includes a tube body and a stop connecting body connected to one end of the tube body, the tube body is provided with a peripheral edge opposite to an outer periphery of one end of the stop connecting body, the stop connecting body includes a connecting tube and a connecting baseplate which integrally carries the connecting tube, the connecting baseplate includes a carrying plate part and one or more connecting arms extending from an outer periphery of the carrying plate part, and the carrying plate is used for connecting and carrying the connecting tube, the at least one connecting arm is connected to an inner peripheral wall of the tube body, and correspondingly, a stop connecting hole is formed in the tube body, and the peripheral edge is abutted against the top end of the liquid storage tube.

Further, the adjustment ring is formed with a smoke outlet which is connected to the atomization head through the second sleeve.

Further, the atomizer further includes a base assembly, wherein the base assembly includes a base, a base connector, an air adjustment inner ring, an air adjustment ring, a contact electrode and an insulation ring, the atomization head is mounted on the base, a bottom end of the second sleeve is detachably connected with the base, the base connector is connected to the base, the air adjustment inner ring is fixed at a bottom end of the base connector, the air adjustment ring is sleeved on the air adjustment inner ring, the insulation ring is sleeved on the contact electrode, the insulation ring and the contact electrode are embedded in the air adjustment inner ring and set close to a bottom end of the air adjustment inner ring, the contact electrode is conductively connected to the atomization head, the air adjustment inner ring is formed with a first air inlet, the air adjustment ring is formed with a second air inlet, and the second air inlet is communicated with/staggered from the first inlet by rotating the air adjustment ring.

Further, the first sleeve is set on an upper end of the adjustment ring, the first sleeve and the adjustment ring are integrally molded to form an inner sleeve, and the one or more stop through holes are formed on a step surface connecting the adjustment ring and the first sleeve, the second sleeve is correspondingly provided with the clamping pieces with the number equal to the number of the stop through holes, the first sleeve is sleeved on the outer periphery of the atomization head, the second sleeve is sleeved on the outer periphery of the first sleeve, and the clamping pieces pass through the corresponding stop through holes.

Further, the atomizer further includes a liquid injection assembly, wherein the liquid injection assembly includes a liquid injection part, an upper cover and a rotating shaft, one end of the liquid injection part is connected to a top end of the liquid storage tube, and an end face of the other end of the liquid injection part is formed with a first liquid injection hole, a first smoke outlet, and a first shaft hole, the first liquid injection hole is communicated with the liquid storage tube, and the upper cover is formed with a second shaft hole corresponding to the first shaft hole and a second smoke outlet corresponding to the first smoke outlet, one end of the rotating shaft is set in the first shaft hole, and the other end of the rotating shaft is set in the second shaft hole, so that the upper cover can rotate relative to the liquid injection part around the rotating shaft to cover or open the first liquid injection hole.

Further, the liquid injection assembly further includes a sealing part set between the liquid injection part and the upper cover, and the sealing part is embedded in an end of the liquid injection part facing the upper cover.

Further, the liquid injection part and the upper cover are both ceramic pieces.

Further, a first clamping part is set on the end of the liquid injection part facing the upper cover, and a second clamping part corresponding to the first clamping part is set on the upper cover, and when the upper cover covers the liquid injection part, the first clamping part and the second clamping part are engaged with each other.

Further, the atomizer further includes a base assembly, wherein the base assembly includes a base and a thread ring, the thread ring is threaded connected to one end of the base, and one end of the atomization head is mounted in an inner chamber of the base after passing through the thread ring.

An electronic cigarette, which includes any one of the above atomizers.

Compared with the prior art, the atomizer of the present disclosure adjusts the inflow amount of the cigarette liquid flowing into the atomization head by rotating the adjustment ring to make the first liquid inlet hole to be communicated with/staggered from the second liquid inlet hole, instead of disassembling the atomizer to make the adjustment. The operation is very convenient.

The preferred embodiments of the present disclosure and its beneficial effect will be further described in detail with reference to the specific embodiments

BRIEF DESCRIPTION OF DRAWINGS

The accompanying drawings are included to provide a further understanding the present disclosure and constitute a part of the description, are used for explaining the present disclosure together with the following specific implementations, and should not be construed to limit the present disclosure. In the accompanying drawings.

| Description of the symbols: | |
|---|---|
| liquid storage tube | 1 |
| liquid storage chamber | 11 |
| liquid adjustment assembly | 2 |
| adjustment ring | 21 |
| first sleeve | 22 |
| second sleeve | 23 |
| inner sleeve | 24 |
| clamping groove | 211 |
| stop through hole | 212 |
| cover top wall | 213 |
| cover annular wall | 214 |
| protruding part | 215 |
| second liquid inlet | 221 |
| main body plate | 222 |
| connecting end | 223 |
| liquid storage end | 224 |
| clamping piece | 225 |
| third liquid inlet hole | 231 |
| base assembly | 3 |
| base | 31 |
| air adjusting inner ring | 32 |
| air adjustment ring | 33 |
| contact electrode | 34 |
| insulation ring | 35 |
| base connecting part | 36 |
| thread ring | 37 |
| circular baseplate | 311 |
| circular ring | 312 |
| screwing part | 313 |
| circular plate | 314 |

-continued

| Description of the symbols: | |
|---|---|
| cylindrical boss | 315 |
| first air inlet | 321 |
| lower cover bottom wall | 322 |
| lower cover peripheral wall | 323 |
| second air inlet | 331 |
| connecting part | 361 |
| outer ring edge | 362 |
| liquid injection assembly | 4 |
| liquid injection part | 41 |
| upper cover | 42 |
| rotating shaft | 43 |
| sealing part | 44 |
| seal abutting part | 411 |
| conduit | 412 |
| liquid injection hole | 413 |
| abutting edge | 414 |
| tube body | 415 |
| stop connecting body | 416 |
| connecting tube | 417 |
| connecting baseplate | 418 |
| cover end wall | 421 |
| cover peripheral wall | 422 |
| boss | 423 |
| smoke outlet | 424 |
| second smoke outlet hole | 425 |
| second shaft hole | 426 |
| second clamping part | 427 |
| second liquid injection hole | 441 |
| third smoke outlet hole | 442 |
| peripheral edge | 4151 |
| groove | 4152 |
| carrying plate part | 4181 |
| connecting arm | 4182 |
| first liquid injection hole | 4191 |
| first smoke outlet hole | 4192 |
| first shaft hole | 4193 |
| first clamping part | 4194 |
| atomization head | 5 |
| first liquid inlet | 51 |
| chuck | 52 |
| tube sleeve | 53 |
| tube part | 54 |
| first silicone pad | 61 |
| second silicone pad | 62 |
| insulation ring | 63 |
| cigarette holder | 101 |
| battery assembly | 102 |

DESCRIPTION OF EMBODIMENTS

The specific embodiments of the present disclosure are described in detail below with reference to the accompanying drawings. It should be understood that the specific embodiments described herein are only used for describing and explaining the present disclosure, but not for limiting the present disclosure.

First Embodiment

Figure 1:
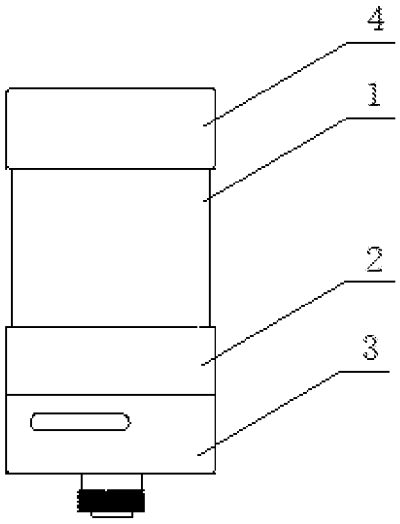
FIG. 1 is a perspective view of an atomizer according to a first preferred embodiment of the present disclosure.
Figure 2:
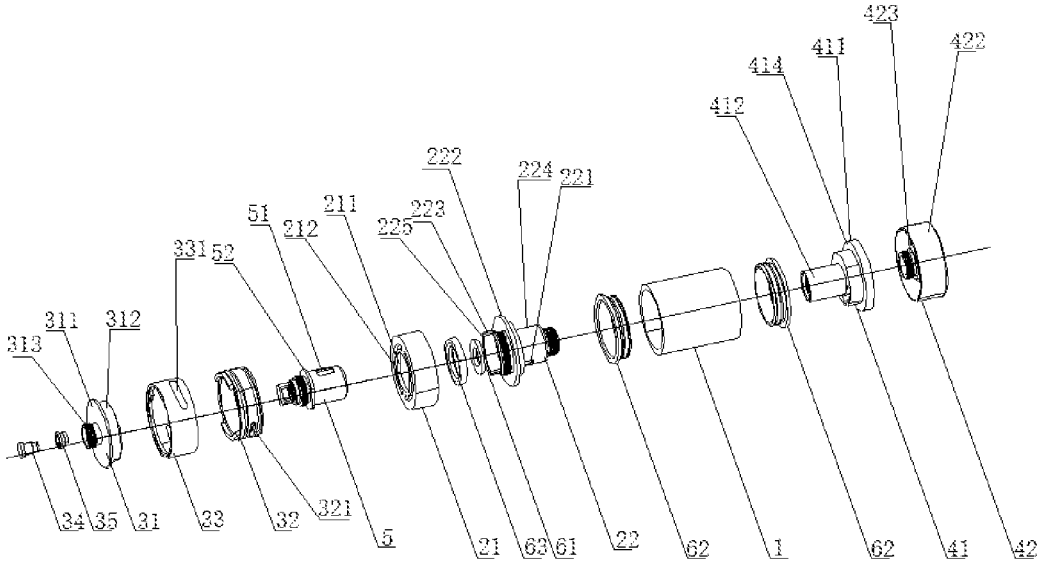
FIG. 2 is an exploded view of the atomizer shown in FIG. 1.
Figure 3:
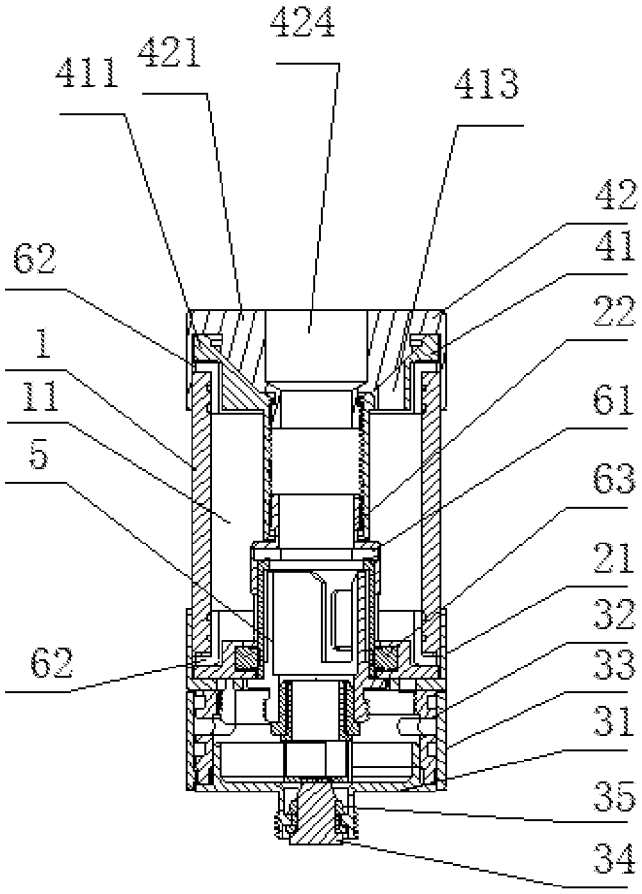
FIG. 3 is a half-sectional view of the atomizer shown in FIG. 1.

Referring to FIG. 1 to FIG. 3, the first embodiment of the present disclosure provides an atomizer, which includes a liquid storage tube 1, a liquid adjustment assembly 2 and an atomization head 5. The atomization head 5 is installed in the liquid adjustment assembly 2, the atomization head 5 is provided with a first liquid inlet 51, and the liquid adjustment assembly 2 is provided with a second liquid inlet 221, which is arranged correspondingly to the first liquid inlet 51, wherein the liquid storage tube 1 and the liquid adjustment assembly 2 form an outline of the atomizer. Therefore, the liquid adjustment assembly 2 can be rotated at the outside of the atomizer to adjust the communication area of the second liquid inlet 221 and the first liquid inlet 51 so that, when using the atomizer, a user can change the amount of the cigarette liquid entering the atomization head 5, which makes the amount of smoke controllable and user experience improved.

Further, according to a preferred embodiment of the present embodiment, the atomizer further includes a base assembly 3 and a liquid injection assembly 4. The liquid adjustment assembly 2 and the base assembly 3 are sequentially connected to the bottom end of the liquid storage tube 1, and the liquid injection assembly 4 is connected to the top end of the liquid storage tube 1. The liquid storage tube 1 is used to store the cigarette liquid, the liquid adjustment assembly 2 is used to adjust the flow amount of cigarette liquid during smoking, the atomization head 5 is used to atomize the cigarette liquid, and the base assembly 3 is used to adjust the inflow amount of air during smoking.

Referring to FIG. 2 and FIG. 3, according to a preferred embodiment of the present embodiment, the liquid adjustment assembly 2 includes a first sleeve 22, wherein a part of the first sleeve 22 is sleeved in one end of the liquid storage tube 1. The center axis of the first sleeve 22 coincides with the central axis of the liquid storage tube 1, which is also convenient for assembly and production. The space between the first sleeve 22 and the liquid storage tube 1 is a liquid storage chamber 11 used for storing cigarette liquid.

The base assembly 3 includes a base 31, and the liquid injection assembly 4 includes a liquid injection part 41 and an upper cover 42. The atomization head 5 is installed on the base 31, the first sleeve 22 is sleeved on the outer periphery of the atomization head 5, the liquid storage tube 1 is sleeved on the outer periphery of the first sleeve 22, the liquid injection part 41 is sealed against one end, away from the base 31, of the liquid storage tube 1, and the upper cover 42 is covered on the liquid injection part 41.

The base 31 includes a circular baseplate 311 and a circular ring 312 formed on a plate surface of the circular baseplate 311. The outer diameter of the circular ring 312 is smaller than the diameter of the circular baseplate 311. The circular ring 312 is arranged on the circular baseplate 311 in a protruding mode. A screwing part 313 is formed on a central part of a plate surface of the circular ring 312 opposite to the circular ring 312. A pipeline of the screwing part 313 passes through the circular baseplate 311.

Figure 4:
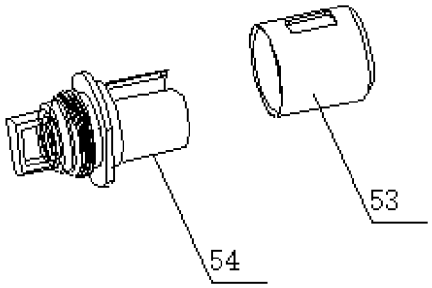
FIG. 4 is a perspective view of an atomization head shown in FIG. 2.

The atomization head 5 is used to atomize the cigarette liquid, so as to achieve the effect of "blow a cloud" during smoking. The atomization head 5 is provided with a first liquid inlet 51 on an outer peripheral wall at the end close to the upper cover 42, for introducing the cigarette liquid into an inner chamber of the atomization head 5. One end of the atomization head 5, far away from the upper cover 42, is used for conductively connecting to the power supply and emits heat by means of the power of the battery, so as to make the cigarette liquid flowing into the chamber heated and atomized. The middle of the outer periphery of the atomization head 5 is further flanged with a chuck 52 for clamping connection to the liquid adjustment assembly 2. The chuck 52 has a non-circumferential structure and is rotated by the liquid adjustment assembly 2. In this embodiment, the chuck 52 has a proximate rectangular structure. Referring to FIG. 4, in this embodiment, one end of the atomization head 5 provided with the first liquid inlet 51 is a tube part 54 formed in cooperation with a tube sleeve 53. The tube part 54 is provided with a liquid inlet groove, a through hole is formed on the peripheral wall of the tube sleeve 53, the tube sleeve 53 is fixedly sleeved on the tube part 54, and the through hole is communicated with the liquid inlet groove in alignment to form the first liquid inlet 51.

The first sleeve 22 is sleeved on the atomization head 5 so as to control the inflow amount of the cigarette liquid into the atomization head 5. The first sleeve 22 includes a main body plate 222 as well as a connecting end 223 and a liquid storage end 224 which are oppositely formed on plate surfaces of the main body plate 222 at its two sides. The main body plate 222 is a circular plate; the connecting end 223 includes two clamping pieces 225, and the two clamping pieces 225 are arc pieces, distributed on the same circumference, and symmetrically arranged around the center of the circumference. The liquid storage end 224 is of a tubular structure. For aligned with or staggered from the first liquid inlet 51, a second liquid inlet 221 is formed on the circumference wall of the liquid storage end 224 at one end used for the installation of the first liquid inlet 51 arranged on the atomization head 5 in the pipeline of the liquid storage end 224. One end connecting the liquid storage end 224 with the main body plate 222 passes through the main body plate 222 to communicate with the space between the two clamping pieces 225. The liquid storage end 224 has a convex structure at one end away from the main body plate 222, and screw threads are formed on the outer peripheral face of the convex end to connect with the liquid injection part 41.

The liquid storage tube 1 is a hollow circular tube, which is penetrable at both ends, for being sleeved on the liquid storage end 224, so that a space for storing the cigarette liquid is formed between the inner peripheral face of the liquid storage tube 1 and the outer peripheral face of the liquid storage end 224. In this embodiment, the liquid storage tube 1 is a glass tube, which is convenient for the user to observe the storage amount of the cigarette liquid.

The liquid injection part 41 is installed on one end of the liquid storage tube 1 away from the first sleeve 22, and the cigarette liquid can be injected into the space for storing the cigarette liquid through the liquid injection part 41. The liquid injection part 41 includes a sealing abutting part 411 and a conduit 412 integrally connected to a central part of one end of the sealing abutting part 411. The conduit 412 is detachably connected to the liquid storage end 224. In this embodiment, the conduit 412 is detachably connected to the liquid storage end 224 through the screw threads. In this embodiment, the liquid injection part 41 is funnel-shaped, the sealing abutting part 411 is formed at one end of a tapered part of the funnel-shaped liquid injection part 41, and the conduit 412 is communicated with the other end of the tapered part. Specifically, a tapered hole is formed on an end face of the sealing abutting part 411 for connecting to one end of the conduit 412, and a circular hole is further formed at the tip of the tapered hole and is communicated with the pipeline of the conduit 412. The screw threads are formed on the hole wall of the circular hole and the inner wall of the conduit 412, for the respective threaded connections with the upper cover 42 and the liquid storage end 224 of the first sleeve 22. The sealing abutting part 411 of the funnel-shaped liquid injection part 41 is formed with a liquid injection hole 413 in an axial direction on the hole wall, which is formed after the tapered hole is formed, so that the cigarette liquid can be injected into the space for storing the cigarette liquid. Stepped grooves are formed on the end face of the sealing abutting part 411 for connecting to one end of the conduit 412, and an abutting edge 414 is correspondingly formed on the outer periphery of the sealing abutting part 411.

The upper cover 42 is used to cover the liquid injection part 41. The upper cover 42 includes a cover end wall 421 and a cover peripheral wall 422 surrounding the outer periphery of the cover end wall 421. The upper cover 42 also has a boss 423 protruding therein. The boss 423 includes a base end and a protruding end integrally connected to the top of the base end. The base end is in tapered, and corresponds to the size of the tapered hole of the liquid injection part 41. The protruding end is cylindrical, and is connected to the top end of the tapered base end. The outer peripheral face of the protruding end are provided with screw threads for engagement with the screw threads on the hole wall of the circular hole of the liquid injection part 41. In addition, the cover end wall 421 is provided with a smoke outlet 424, and the smoke outlet 424 extends in the axial direction, and integrally passes through the base end and the protruding end of the boss 423.

The liquid adjustment assembly 2 further includes an adjustment ring 21, the adjustment ring 21 is in clamping connection on the outer periphery of the atomization head 5, and the adjustment ring 21 is twisted to drive the atomization head 5 to rotate. The adjustment ring 21 has a cylindrical structure and includes a first end face and a second end face opposite to the first end face. The first end face is provided with a circular groove whose hole diameter matches with the diameter of the main body plate 222, such that the main body plate 222 can be installed in the circular groove. The second end face is formed with a circular hole, the circular hole is communicated with the circular groove, the hole diameter of the circular hole corresponds to the outer diameter of the end of the atomization head 5 formed with the first liquid inlet 51 for its passing through. The second end face is further provided with a clamping groove 211 on the periphery of the circular hole, and the clamping groove 211 corresponds to the size of the chuck 52, for clamping the chuck 52, so that the adjustment ring 21 can drive the atomization head 5 to rotate synchronously. Accordingly, an annular wall is formed between the center hole (that is, the circular groove, the circular hole and the clamping groove 211) of the adjustment ring 21 and the outer peripheral face of the adjustment ring 21. The end face of the annular wall is axially formed with stop through holes 212 with the number equal to that of the clamping pieces 225. In the present embodiment, two stop through holes 212 are formed, and the stop through holes 212 penetrates through the annular wall. The stop through holes 212 are arc-shaped through holes, located on the same circumference, and oppositely arranged. The two stop through holes 212 are respectively used for passing through the two clamping pieces 225. The two clamping pieces 225 can penetrate into the stop through holes 212. The clamping pieces 225 are used to limit the rotation of the adjustment ring 21.

The base assembly 3 further includes an air adjustment inner ring 32, an air adjustment ring 33, a contact electrode 34, and an insulation ring 35. The air adjustment inner ring 32 is sleeved on the outer periphery of the circular ring 312, and a first air inlet 321 is formed on the peripheral wall of the air adjustment inner ring 32. The air adjustment ring 33 is sleeved on the outer periphery of the air adjustment inner ring 32. A second air inlet 331 is formed on the peripheral wall of the air adjustment ring 33. When the air adjustment ring 33 rotates relative to the adjustment inner ring 32, the second air inlet 331 is aligned with or staggered from the first air inlet 321. The contact electrode 34 is used to penetrate into the screwing part 313 and is conductively connected to one end of the atomization head 5. The insulation ring 35 is sleeved on the outer peripheral of the contact electrode 34 to insulate the contact electrode 34 from a foreign object.

Figure 5:
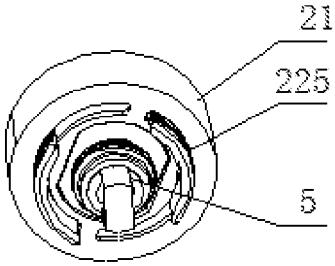
FIG. 5 is a perspective view after both the atomization head and a first sleeve are installed in an adjustment ring shown in FIG. 2.

Referring to FIG. 5, in case of the installation of the liquid-adjusting-outside atomizer, the atomization head 5 is installed on the base 31, one end of the atomization head 5 for electrical connection cooperates with one end of the annular ring 312 and is abutted against the hole position penetrating through the circular baseplate 311 of the screwing part 313. The air adjustment inner ring 32 is sleeved on the outer periphery of the annular ring 312, and the first air inlet 321 extends beyond the height of the annular ring 312. The air adjustment ring 33 is rotatably sleeved on the outer periphery of the air adjustment inner ring 32, and the second air inlet 331 and the first air inlet 321 are correspondingly located at the position with the same height. The adjustment ring 21 is sleeved on the end of the atomization head 5 formed with the first liquid inlet 51, the end of the atomization head 5 formed with the first liquid inlet 51 penetrates out through the adjustment ring 21, and the chuck 52 is clamping into the clamping groove 211. The first sleeve 22 is installed on the atomization head 5, the main body plate 222 is sleeved into the circular groove of the adjustment ring 21, the two clamping pieces 225 respectively penetrate into the two stop through holes 212, the end of the atomization head 5 formed with the liquid inlet 51 extends into the pipeline of the liquid storage end 224, and the first liquid inlet 51 and the second liquid inlet 221 are located at the position with the same height. The liquid storage tube 1 is sleeved on the outer periphery of the liquid storage end 224, the bottom end of the liquid storage tube 1 is abutted against the main body plate 222, and a space for storing cigarette liquid is formed between the inner peripheral face of the liquid storage tube 1 and the outer peripheral face of the liquid storage end 224. The liquid injection part 41 is installed on one end of the liquid storage tube 1 close to the upper cover 42, the conduit 412 extends into a tube of the liquid storage tube 1 and is in threaded connection with the liquid storage end 224, and the abutting edge 414 is abutted against the top of the liquid storage tube 1. The liquid injection hole 413 is communicated with the space for storing the cigarette liquid. The upper cover 42 covers the liquid injection part 41, the base end of the boss 423 extends into the tapered hole of the liquid injection part 41, the protruding end of the boss 423 extends into the circular hole of the sealing abutting part 411 to enable the threaded connection, the cover peripheral wall 422 are sleeved on the periphery of the liquid injection part 41 and the top of the liquid storage tube 1, and the smoke outlet 424, the pipeline of the liquid storage end 224 as well as the inner chamber of the atomization head 5 are communicated to form a smoke channel.

When the flow amount of the cigarette liquid of the atomizer is adjusted, the atomization head 5 is driven to rotate by rotating the adjustment ring 21, so as to make the first liquid inlet 51 and the second liquid inlet 221 to be communicated with or staggered from each other, and thus realize that the inflow amount of the cigarette liquid between the atomization head 5 and the liquid storage tube 1 into the inner chamber of the atomization head 5 can be controlled. The rotation range of the adjustment ring 21 is limited by the blocking of the two clamping pieces 225. When a preset rotation angle is reached, one end of the stop through hole 212 is blocked by the clamping piece 225, at this time, the first liquid inlet 51 is completely communicated and aligned with the second liquid inlet 221, resulting in the maximum inflow amount of the cigarette liquid. Then, the adjustment ring 21 is reversely rotated to make the first liquid inlet 51 and the second liquid inlet 221 gradually stagger till completely stagger, so that the inflow amount of the cigarette liquid gradually reduces till no cigarette liquid can flow in. After being completely cut off, the other end of the stop through hole 211 is blocked by the clamping piece 225 to limit a further rotation.

By rotating the air adjustment ring 33, the first inlet 321 and the second inlet 331 are communicated with or staggered from each other. Therefore, the air flow amount of the atomizer can be adjusted.

Understandably, the threaded connections described above can all be replaced by other detachable connection methods, such as a clamping connection, a plugging connection and a magnetic connection.

Further, in order to improve the seal tightness of the cigarette liquid, a first silicon pad 61 may be set at the connecting position between the bottom end of the convex end in the tube of the liquid storage end 224 and the top end of the atomization head 5, and second silicon pads 62 may be set respectively at the connecting position between the liquid storage tube 1 and the first sleeve 22 as well as at the connecting position between the liquid storage tube 1 and the liquid injection part 41.

Further, in order to improve the insulativity between the atomization head 5 and the first sleeve 22, an insulation ring 63 is sleeved on the bottom end of the liquid storage end 224.

Further, the shape of the first liquid inlet 51 and the second liquid inlet 221 are not limited, and may be a regular shape, such as any one of a square, a circle, a fan, a triangle and the like, or may be an irregular shape. The size of the second liquid inlet 221 may be larger than, equal to or smaller than the size of the first liquid inlet 51. In this embodiment, the first liquid inlet 51 and the second liquid inlet 221 are strip-shaped holes extending along the axis of the peripheral wall. The length of the first liquid inlet 51 is approximately equal to that of the second liquid inlet 221.

It can be understood that in other embodiments, the number of the clamping pieces 225 may also be one, three or more, and the number of the stop through holes 212 is equal to the number of the clamping pieces 225.

Figure 6:
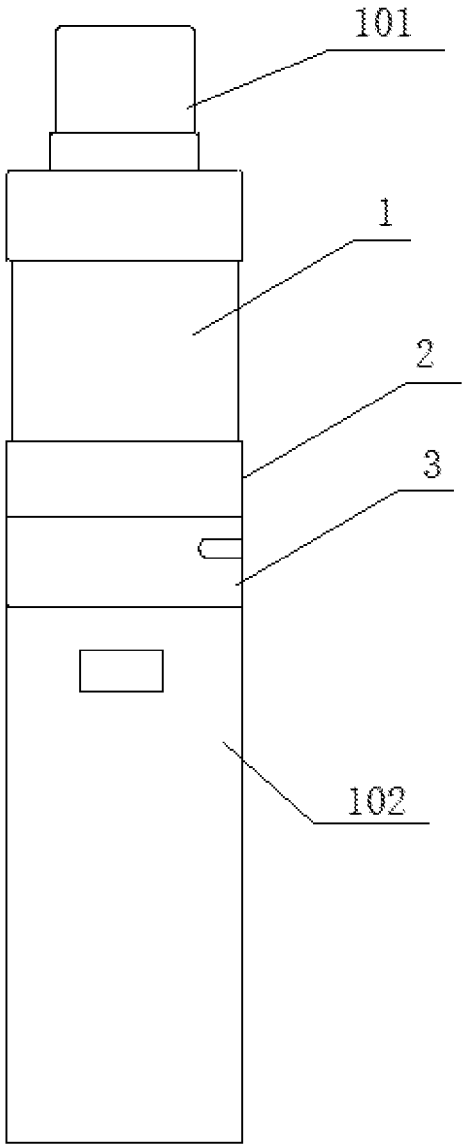
FIG. 6 is a perspective view of an electronic cigarette having the atomizer shown in FIG. 1.

Referring to FIG. 6, the electronic cigarette with a liquid—adjusting-outside atomizer, includes a cigarette holder 101 and a battery assembly 102 respectively mounted on two ends of the atomizer. The cigarette holder 101 is connected to the top end of the upper cover 42, and the battery assembly 102 is connected to the bottom end of the base 31. When the electronic cigarette is used, the atomization head 5 is powered by the battery assembly 102, the cigarette liquid flows into the atomization head 5 and is heated and converted into smoke vapor, and the smoke vapor flows from the smoke channel to the cigarette holder 101 for the user to smoke.

In conclusion, the liquid—adjusting-outside atomizer and the electronic cigarette using the same, according to the first embodiment of the present disclosure, drive the atomization head 5 to rotate by rotating the adjustment ring 21, so that the first liquid inlet 51 is communicated with or staggered from the second liquid inlet 221. Accordingly, the inflow amount of the cigarette liquid at the outside of the inner chamber of the atomization head 5 into the inner chamber of the atomization head 5 can be adjusted without the need to disassemble the atomizer for adjustment, and the operation is extremely convenient.

In addition, when the liquid storage tube 1 is a glass tube, it is not only convenient for the user to observe the storage amount of the cigarette liquid, but also helps the user to observe whether the first liquid inlet 51 is communicated with or staggered from the second liquid inlet 221.

Second Embodiment

Figure 7:
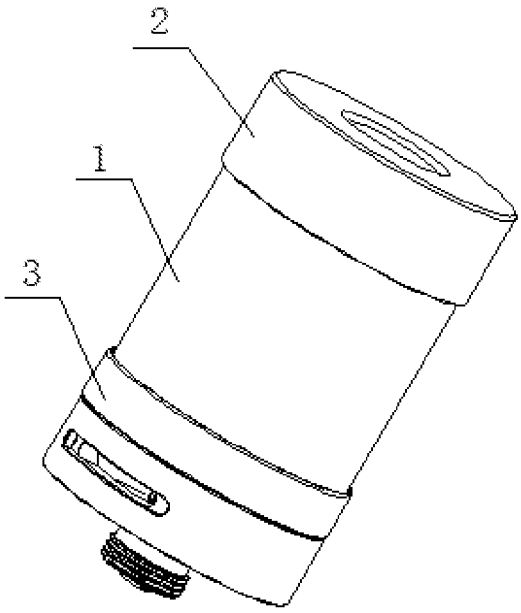
FIG. 7 is a perspective view of an atomizer according to a second preferred embodiment of the present disclosure.
Figure 8:
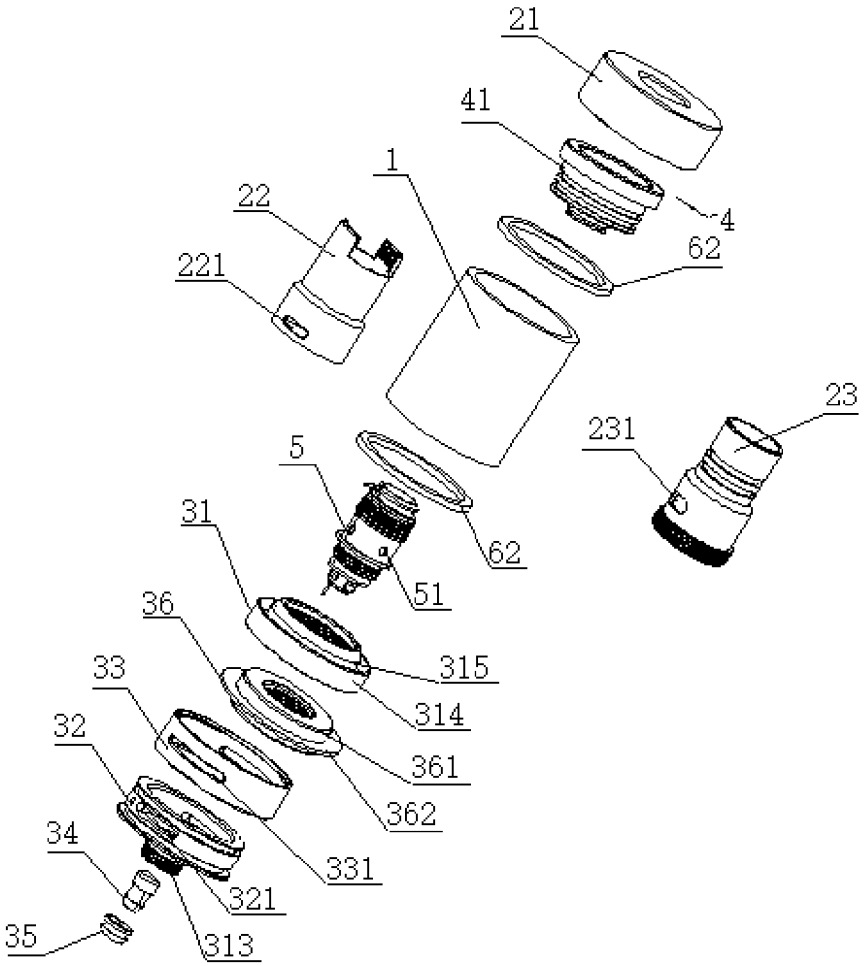
FIG. 8 is an exploded view of the atomizer shown in FIG. 7.
Figure 9:
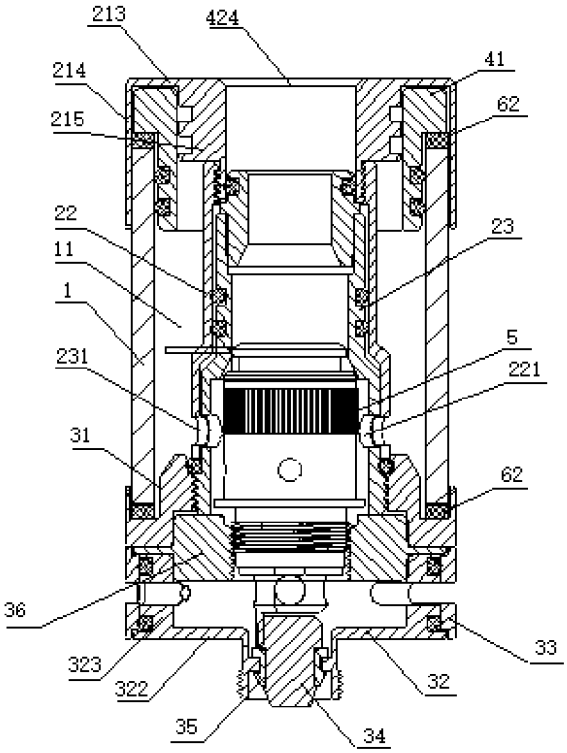
FIG. 9 is a half-sectional view of the atomizer shown in FIG. 7.

Referring to FIG. 7 to FIG. 9, an atomizer is provided according to the second embodiment of the present disclosure, and includes a liquid storage tube 1, a liquid adjustment assembly 2 and an atomization head 5. The atomization head 5 is installed in the liquid adjustment assembly 2, the atomization head 5 is formed with a first liquid inlet 51, and the liquid adjustment assembly 2 is formed with a second liquid inlet 221, wherein, the liquid storage tube 1 and the liquid adjustment assembly 2 form the outline of the atomizer Therefore, the liquid adjustment assembly 2 can be rotated at the outside of the atomizer to adjust the communication area of the second liquid inlet 221 and the first liquid inlet 51, so as to change the inflow amount of the cigarette liquid into the atomization head 5 when the user uses the atomizer, to make the amount of smoke be controllable, and to improve user experience.

Further, according to a preferred embodiment of the present embodiment, the atomizer further includes a base assembly 3 and a liquid injection assembly 4. The liquid adjustment assembly 2, the liquid storage tube 1, and the base assembly 3 are sequentially arranged in a stacked mode, the liquid storage tube 1 is used for storing the cigarette liquid, the liquid adjustment assembly 2 is used for adjusting the flow amount of the cigarette liquid during smoking, the atomization head 5 is used to atomize the cigarette liquid, and the base assembly 3 is used for adjusting the air inflow amount during smoking.

Referring to FIG. 8 and FIG. 9, the base assembly 3 includes a base 31, the liquid adjustment assembly 2 includes a second sleeve 23, and the liquid injection assembly 4 includes a liquid injection part 41. The atomization head 5 is installed on the base 31, the second sleeve 23 is sleeved on the outer periphery of the atomization head 5, the liquid storage tube 1 is sleeved on the outer periphery of the second sleeve 23, the liquid injection part 41 is installed on the end of the liquid storage tube 1 away from the base 31, the bottom end of the second sleeve 23 is detachably connected to the base 31, and the top end of the second sleeve 23 and the liquid injection part 41 are fixedly connected. In this embodiment, the liquid storage tube 1 is a glass tube, which is convenient for the user to observe the residual amount of cigarette liquid in the atomizer and to judge whether the cigarette liquid should be supplied or not.

The base 31 includes a circular plate 314 and a circular boss 315 formed in the circular plate 314. An annular groove is formed between the inner side of the peripheral wall of the circular plate 314 and the outer peripheral face of the cylindrical boss 315. The bottom surface of the base 31 is provided with an inner chamber, and threads are formed on a peripheral wall of the inner chamber. The inner chamber extends upwards to the inside of the cylindrical boss 315 and forms a partition wall with the top surface of the cylindrical boss 315, and the central part of the partition wall is provided with a perforation communicated with the inner chamber.

The atomization head 5 is an atomizing component for atomizing the entered cigarette liquid so as to achieve the effect of "blow a cloud" during smoking. In this embodiment, the atomization head 5 emits heat by means of the power of the battery to make the inflow cigarette liquid atomized by heating. The atomization head 5 is commercially available. One end of the atomization head 5 can penetrate the perforation on the top surface of the cylindrical boss 315 into the inner chamber of the base 31, and the atomization head 5 is formed with a first liquid inlet 51.

The second sleeve 23 is a tube body penetrable at both ends, and a third liquid inlet 231 is formed on the tube wall close to the bottom end. The shape of the third liquid inlet 231 is not limited and may be a regular shape, such as a square, a circle, a fan shape, a triangle shape, or the like, or an irregular shape. In this embodiment, the third liquid inlet 231 is a strip-shaped hole arced extending along the peripheral wall, and the outer wall of the bottom end of the second sleeve 23 is provided with screw threads.

It can be understood that, in other embodiments, since the atomization head 5 is formed with the first liquid inlet 51 for guiding the cigarette liquid into the inner chamber of the atomization head 5, the second sleeve 23 can be omitted.

Figure 10:
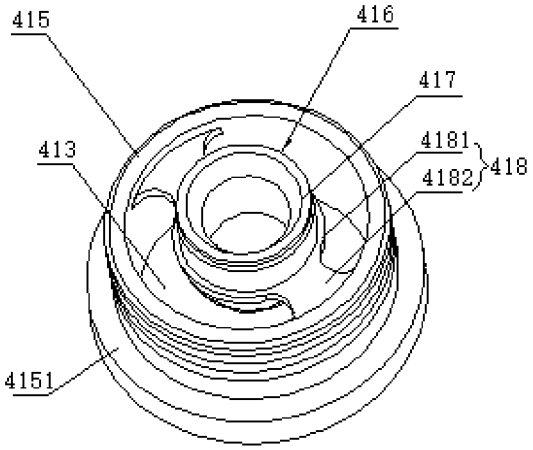
FIG. 10 is a perspective view of a liquid injection part of a liquid injection assembly of the atomizer shown in FIG. 8.

Referring to FIG. 10, the lower end of the liquid injection part 41 is tightly connected to the upper end of the second sleeve 23, the upper end of the liquid injection part 41 is hermetically connected to the upper edge of the liquid storage tube 1, and the liquid injection part 41 includes a tube body 415 and a stop connecting body 416 connected to one end of the tube body 415. A peripheral edge 4151 is formed on an outer periphery of one end of the tube body 415 opposite to the stop connecting body 416, the stop connecting body 416 includes a connecting tube 417 and a connecting baseplate 418 which integrally carries the connecting tube 417, the connecting baseplate 418 includes a carrying plate part 4181 and two connecting arms 4182 correspondingly extending from the outer periphery of the carrying plate part 4181, the carrying plate 4181 has a circular plate structure for connecting and carrying the connecting tube 417, the two connecting arms 4182 are respectively connected to the inner peripheral wall of the tube body 415, and corresponding liquid injection holes 413 are formed in the tube body 415 correspondingly. It can be understood that, in other embodiments, the number of the connecting arms 4182 may also be one, three or more, and the number of the formed liquid injection holes 413 is equal to the number of the connecting arms 4182.

The liquid storage tube 1 is a hollow tube, which is penetrable at both ends.

Figure 11:
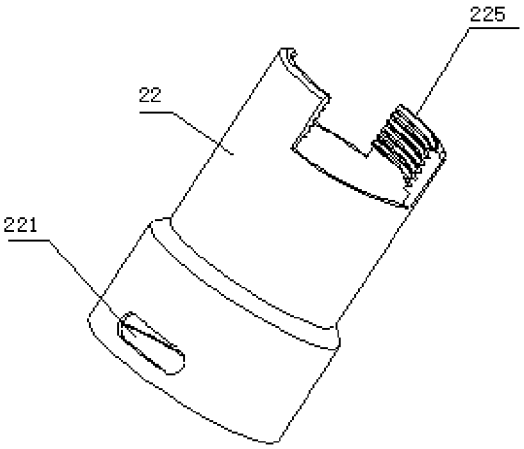
FIG. 11 is a perspective view of a first sleeve of a liquid adjustment assembly of the atomizer shown in FIG. 8.

Referring to FIG. 11, the liquid adjustment assembly 2 further includes an adjustment ring 21 and a first sleeve 22. The adjustment ring 21 and the first sleeve 22 are relatively fixedly connected, the first sleeve 22 is set at the outside of the second sleeve 23 and inside the liquid storage tube 1, the rotation of the adjustment ring 21 can drive the first sleeve 22 to rotate. The inner diameter of the first sleeve 22 is larger than the outer diameter of the second sleeve 23, and the outer diameter of the first sleeve 22 is smaller than the inner diameter of the liquid storage tube 1. A second liquid inlet 221 is formed on the tube wall of the first sleeve 22 close to the bottom end for cooperating with the third liquid inlet 231, so that the two liquid inlets relatively rotate and the two liquid inlets can guide or block the cigarette liquid. The shape of the second liquid inlet 221 is not limited, and it may be a regular shape, such as a square, a circle, a fan, a triangle or the like, or an irregular shape. The size of the second liquid inlet 221 may be larger than, equal to or smaller than the size of the third liquid inlet 231. In this embodiment, the second liquid inlet 221 is a strip-shaped hole arced extending along the peripheral wall, and the length of the second liquid inlet 221 is approximately equal to the length of the third liquid inlet 231. Screw threads are formed in the inner periphery of the top end of the first sleeve 22, the top end of the first sleeve 22 is provided with opposite notches to form two clamping pieces 225, and the clamping pieces 225 can penetrate into the liquid injection holes 413 and can rotate in the liquid injection holes 413. It can be understood that the liquid injection holes 413 is used as stop through holes to limit the rotation of the first sleeve 22 besides used for injecting liquid.

It can be understood that, in other embodiments, when the number of the liquid injection holes 413 is one, three or more, the number of the clamping pieces 225 needs to be adjusted to be equal to the number of the liquid injection holes 413.

Referring to FIG. 9, the adjustment ring 21 and the first sleeve 22 are detachably connected through threads, the adjustment ring 21 includes a cover top wall 213 and a cover annular wall 214 surrounding the cover top wall 213, a protruding part 215 is arranged in the adjustment ring 21 in a protrusion mode, the protruding part 215 includes a base end and a protruding end with a diameter smaller than a diameter of the base end, a gap is formed between the outer peripheral face of the base end and the cover annular wall 214, the outer peripheral face of the protruding end is provided with screw threads, the cover top wall 213 is provided with a smoke outlet 424, the smoke outlet 424 extends integrally through the protruding part 215 in the axial direction, and the smoke outlet 424 is communicated with the atomization head through the second sleeve 23. It can be understood that, in this embodiment, the adjustment ring 21 also serves as an upper cover of the atomizer.

Referring to FIG. 8 and FIG. 9, the base assembly 3 further includes a base connector 36, an air adjustment inner ring 32, an air adjustment ring 33, a contact electrode 34 and an insulation ring 35. The base connector 36 is used for connecting the base 31, the air adjustment inner ring 32 is fixed on the bottom end of the base connector 36, the air adjustment ring 33 is arranged on the air adjustment inner ring 32 in a sleeving manner, the insulation ring 35 is arranged on the contact electrode 34 in a sleeving manner, and the insulation ring 35 and the contact electrode 34 are embedded in the air adjustment inner ring 32 and set close to the bottom end of the air adjustment inner ring 32.

The base connector 36 comprises a connecting part 361, wherein a perforation is formed on the top face of the connecting part 361 and penetrates through the base connector 36 in the axial direction, and a screw thread is formed on the inner circumferential wall surrounding the perforation. An outer edge 362 is formed on the outer periphery of the bottom end of the connecting part 361.

The air adjustment inner ring 32 comprises a lower cover bottom wall 322 and a lower cover circumferential wall 323 formed on the outer periphery of the top face of the lower cover bottom wall 322, the lower cover circumferential wall 323 is provided with a first air inlet 321, and the shape of the first air inlet 321 is not limited and can be a regular shape, such as a square, a circle, a fan, a triangle, or the like, or an irregular shape. In this embodiment, the first air inlet 321 extends along the arc direction of the circumferential wall by a preset length and is a strip-shaped hole. The air adjustment inner ring 32 further comprises a screwing part 313 formed at the center part of the bottom face of the lower cover bottom wall 322, the pipeline of the screwing part 313 is communicated with the space surrounded by the lower cover circumferential wall 323 and the lower cover bottom wall 322.

The air adjustment ring 33 is arranged on the outer periphery of the lower cover circumferential wall 322 in a sleeving manner, the second air inlet 331 is formed on the circumferential wall of the air adjustment ring 33, and the shape of the second air inlet 331 is not limited and may be a regular shape such as a square, a circle, a fan, a triangular, or the like, or may be an irregular shape. The size of the second air inlet 331 may be larger than, equal to or smaller than the size of the first air inlet 321. In this embodiment, the second air inlet 331 extends along the arc direction of the circumferential wall by a predetermined length and is a strip-shaped hole for cooperation with the first air inlet 321. The two air inlets relatively rotate so that they can guide or block the airflow.

The contact electrode 34 and the insulation ring 35 are installed in the pipeline of the screwing part 313, the contact electrode 34 is used to conductively connect to the atomization head 5, and the insulation ring 35 is arranged on the outer periphery of the contact electrode 34 in a sleeving manner to insulate the contact electrode 34 from the foreign object.

When the electronic cigarette atomizer is installed, the connecting part 361 of the base connector 36 extends into the inner chamber of the base 31, the bottom end of the atomization head 5 passes through the perforation on the top face of the base 31 and then enters into the perforation of the connecting part 361 of the base connector 36 to be in threaded connection with the connecting part 361, the second sleeve 23 is arranged on the outer periphery of the atomization head 5 in a sleeving manner and is in threaded connection with the base 31, the first sleeve 22 is closely arranged on the outer periphery of the second sleeve 23 in a sleeving manner, the bottom end of the first sleeve 22 is abutted against the top face of the cylindrical boss 315, and the second liquid inlet 221 of the first sleeve 22 and the third liquid inlet 231 of the second sleeve 23 are correspondingly at the same level, and then the liquid storage tube 1 is arranged on the outer periphery of the first sleeve 22 in a sleeving manner. The bottom end of the liquid storage tube 1 is inserted into the annular groove of the base 31, a liquid storage chamber 11 having an annual space is formed between the liquid storage tube 1 and the first sleeve 22 for containing the cigarette liquid, and then the liquid injection part 41 is installed. The connecting tube 417 is inserted into the top end inside of the tube chamber of the second sleeve 23 to be fixedly connected to the second sleeve 23, the tube body 415 extends into the liquid storage tube 1, and the peripheral edge 4151 of the liquid injection part 41 is pressed against the top of the liquid storage tube 1. At the same time, two clamping pieces 225 at the top end of the first sleeve 22 penetrate through the liquid injection hole 413 of the liquid injection part 41 and enter into the tube chamber of the tube body 415. Then the adjustment ring 21 is installed, and the protruding end of the protruding part 215 of the adjustment ring 21 extends into the top end of the first sleeve 22 and is screwed with the top end of the first sleeve 22. At the same time, one end of the liquid injecting part 41 with the peripheral edge 4151 is placed in the gap between the protruding part 215 of the adjustment ring 21 and the cover ring wall 214. The inner face of the cover top wall 213 abuts the end of the liquid injection part 41 having a peripheral edge 4151, the top end of the liquid storage tube 1 is clamped between the cover annular wall 214 and the tube body 415 of the liquid injection part 41, the air adjustment ring 33 is arranged on the outer periphery of the air adjusting inner ring 32 in a sleeving manner and the air adjustment inner ring 32 is fixed to the bottom end of the base connector 36, then the contact electrode 34 is installed in the pipeline of the screwing part 313 of the air adjustment inner ring 32 and is electrically connected to the bottom end of the atomization head 5, and the insulation ring 35 is installed in the pipeline of the screwing part 313 and is arranged on the contact electrode 34 in a sleeving manner so as to fix the contact electrode 34. In this way, installation of the electronic atomizer is completed.

Figure 12:
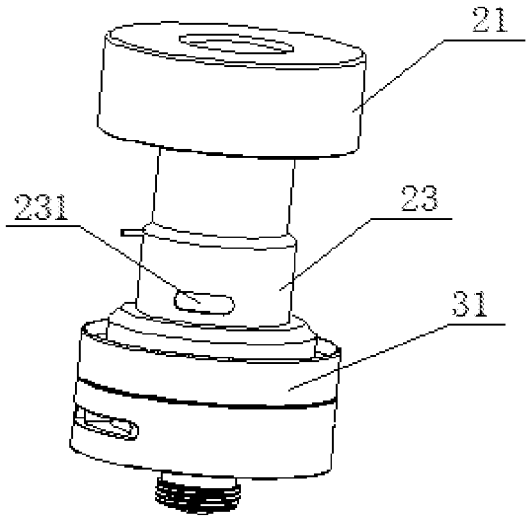
FIG. 12 is a perspective view of a first viewing angle of the atomizer (without an outer tube) according to the second preferred embodiment of the present disclosure when a third liquid inlet hole is closed.
Figure 13:
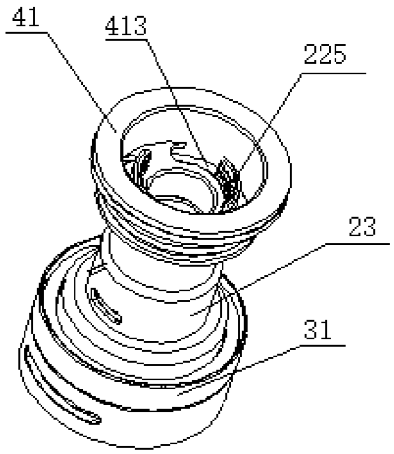
FIG. 13 is a perspective view of a second viewing angle of the atomizer (without the outer tube and the adjustment ring) shown in FIG. 12.
Figure 14:
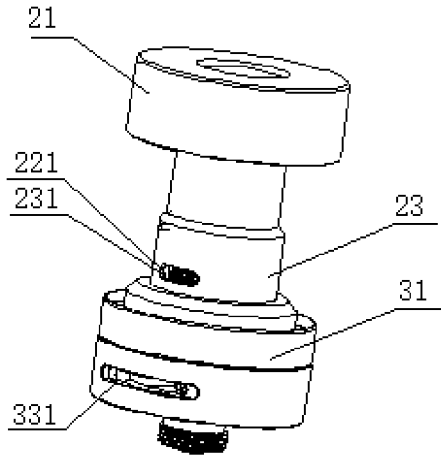
FIG. 14 is a perspective view of a first viewing angle of the atomizer (without an outer tube) according to the second preferred embodiment of the present disclosure when the third liquid inlet hole is opened.
Figure 15:
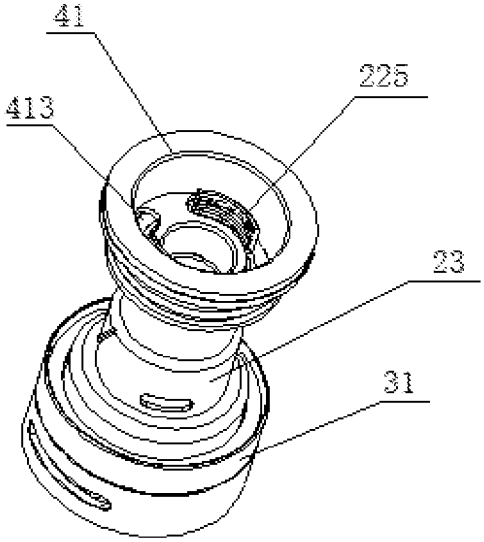
FIG. 15 is a perspective view of a second viewing angle of the atomizer (without the outer tube and the adjustment ring) shown in FIG. 14.
Figure 16:
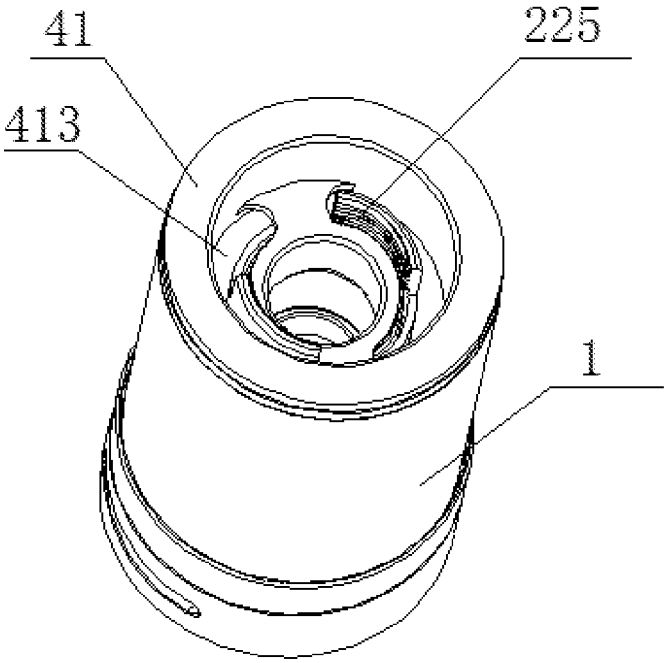
FIG. 16 is a perspective view of a third viewing angle of the atomizer (without the adjustment ring) shown in FIG. 14.

When adjusting the flow of the cigarette liquid, the electronic cigarette atomizer drives the first sleeve 22 to rotate together by rotating the adjustment ring 21, so that the second liquid inlet 221 on the first sleeve 22 is relatively communicated with or staggered from the third liquid inlet 231 on the second sleeve 23 so as to adjust the flow of the cigarette liquid contained between the first sleeve 22 and the liquid storage tube 1 flowing into the second sleeve 23, and the cigarette liquid flowing into the second sleeve 23 can directly flow into the atomization head 5. Referring to FIG. 12 and FIG. 13, by rotating the adjustment ring 21, when the adjustment ring 21 is rotated clockwise, the second liquid inlet 221 on the inner first sleeve 22 is gradually communicated with the third liquid inlet 231, the clamping piece 225 is blocked by the connecting arm 4182 between the liquid injection holes 413 when the adjustment ring 21 cannot be rotated, the second liquid inlet 221 is completely aligned with the third liquid inlet 231 on the second sleeve 23, and the maximum flow of cigarette liquid is reached. Referring to FIG. 14 and FIG. 15, When the adjustment ring 21 is rotated counterclockwise, the second liquid inlet 221 is gradually staggered with respect to the third liquid inlet 231, the liquid flow is getting smaller and smaller, the clamping piece 225 is blocked by the connecting arm 4182 between the liquid injection holes 413 and the second liquid inlet 221 is completely aligned with respect to the third liquid inlet 231 on the second sleeve 23 when the adjustment ring 21 cannot be rotated, the second liquid inlet 221 is completely staggered with respect to the third liquid inlet 231 on the second sleeve 23, and the liquid cannot be fed at all. Therefore, the flow of liquid is adjusted by rotating the adjustment ring 21. Further referring to FIG. 16, when the adjustment ring 21 is further rotated anticlockwise, the adjustment ring 21 rotates relative to the first sleeve 22, the second liquid inlet 221 is still completely staggered with respect to the third liquid inlet 231 on the second sleeve 23, after a certain rotating distance, and the adjustment ring 21 can be unscrewed relative to the first sleeve 22 and taken down to expose the liquid injection hole 413. At this time, the cigarette liquid can be directly injected into an annular space between the first liquid storage tube 1 and the first sleeve 22 through the liquid injection hole 413.

Understandably, the screwing connections can all be replaced by other detachable connecting methods, such as a snapping connection, a plugging connection, and a magnetic connection.

It can be understood that, in other embodiments, when the adjustment ring 21 is rotated clockwise, the second liquid inlet 221 is gradually staggered with respect to the third liquid inlet 231, and the liquid flow is getting smaller and smaller. When rotating the adjustment ring 21 counterclockwise, the second liquid inlet 221 in the inner first sleeve 22 is in a state of gradually communicated with the third liquid inlet 231 relatively.

Further, a second silicone pad 62 may be set between the annular groove of the base 31 and the liquid storage tube 1 for improving the seal tightness of the cigarette liquid.

Figure 17:
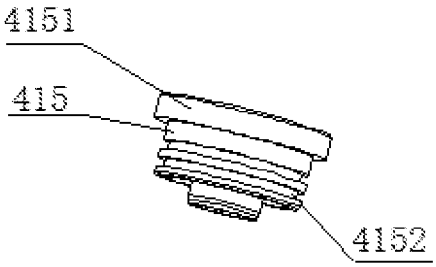
FIG. 17 is a perspective view of another preferred implementation structure of the liquid injection part of the liquid injection assembly of the atomizer according to the second preferred embodiment of the present disclosure.

Further, referring to FIG. 17, in order to improve the seal tightness of the cigarette liquid, at least one groove 4152 may be set on the outer periphery of the tube body 415 for placing the sealing ring.

Figure 18:
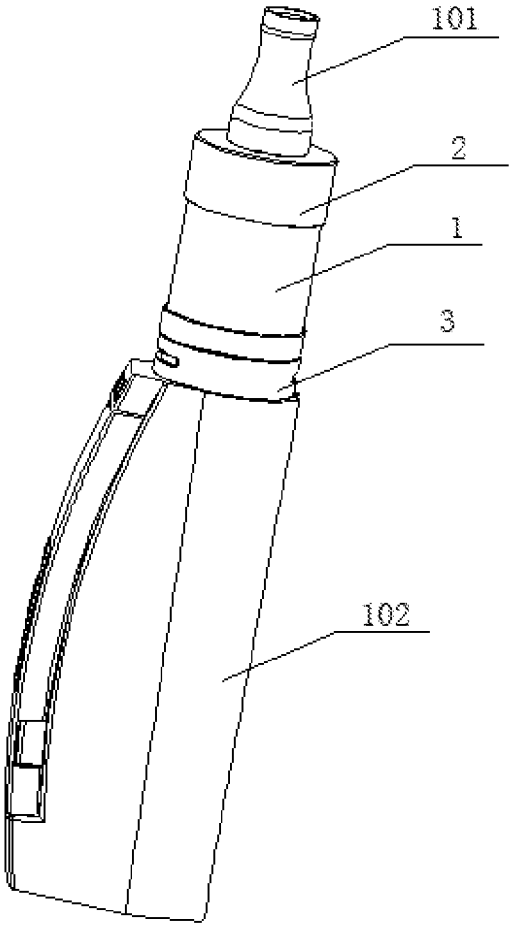
FIG. 18 is a perspective view of an electronic cigarette having the atomizer according to the second preferred embodiment of the present disclosure.
Figure 19:
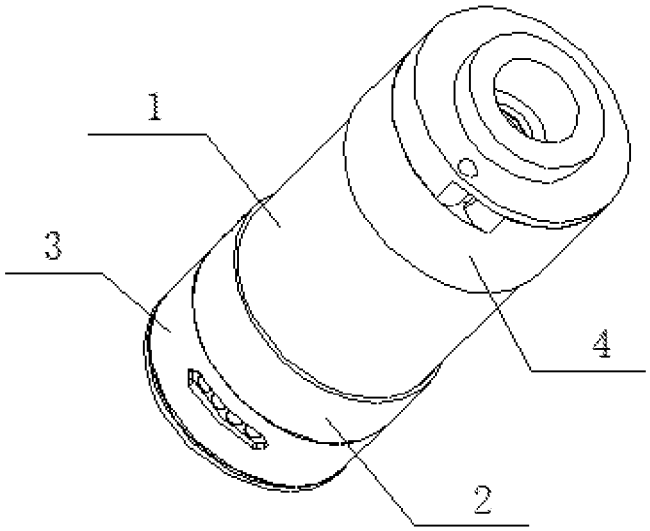
FIG. 19 is a schematic structural view of an atomizer according to a third preferred embodiment of the present disclosure.
Figure 20:
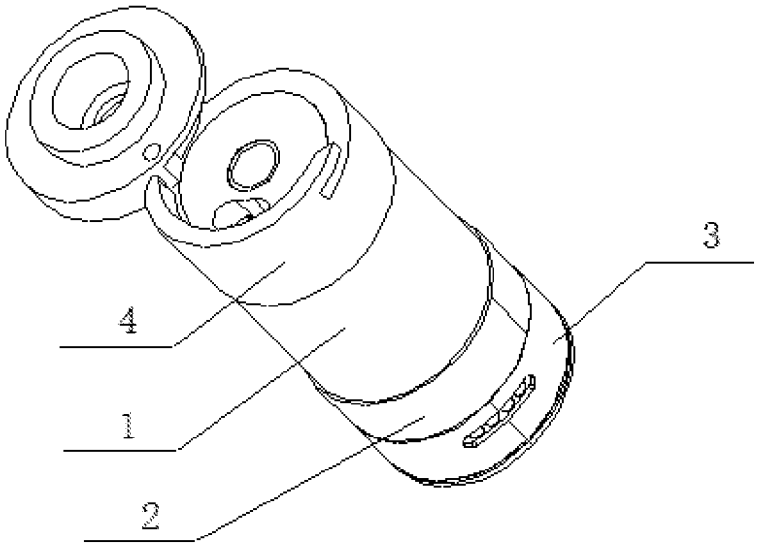
FIG. 20 is a schematic structural view of an opened liquid injection assembly of the atomizer shown in FIG. 19.
Figure 21:
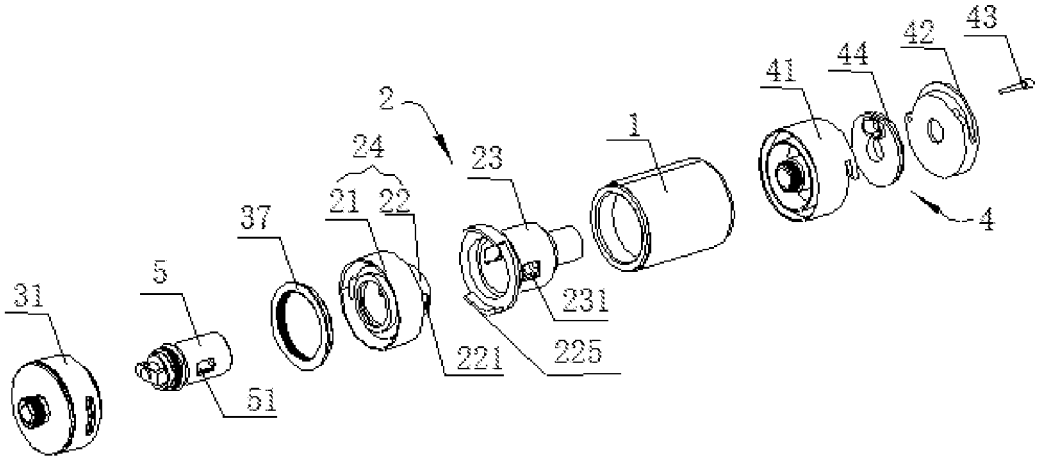
FIG. 21 is an exploded view of the atomizer shown in FIG. 19.
Figure 22:
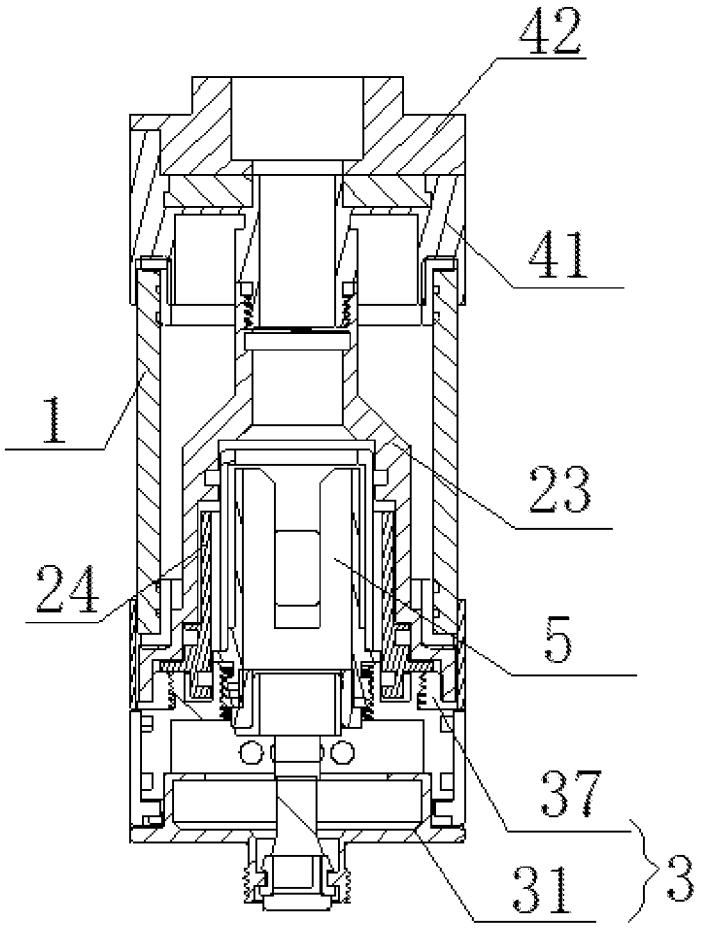
FIG. 22 is a schematic sectional view of the atomizer shown in FIG. 19.
Figure 23:
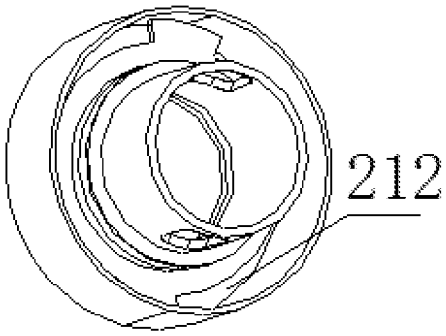
FIG. 23 is a schematic structural view of an inner sleeve shown in FIG. 21.
Figure 24:
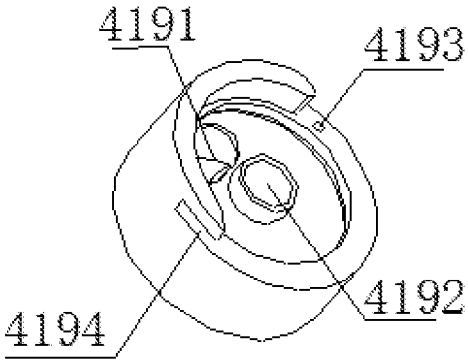
FIG. 24 is a schematic structural view of an liquid injection part shown in FIG. 21.
Figure 25:
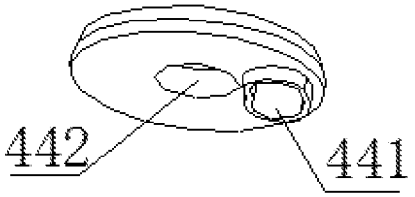
FIG. 25 is a schematic structural view of a sealing part shown in FIG. 21.
Figure 26:
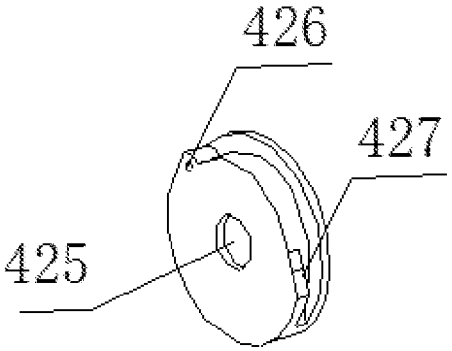
FIG. 26 is a schematic structural view of an upper cover shown in FIG. 21.

Referring FIG. 18, the electronic cigarette with the atomizer of the embodiment comprises a cigarette holder 101 and a battery assembly 102 installed on two ends of the electronic cigarette atomizer. The cigarette holder 101 is connected to the top end of the adjustment ring 21, and the battery assembly 102 is connected to the bottom end of the air adjustment inner ring 32. The battery is installed in the battery assembly 102 to supply power to the atomization head 5 during smoking, and the user smokes through the cigarette holder 101.

In conclusion, the electronic cigarette atomizer with a liquid adjusting function and the electronic cigarette using the same, according to the second embodiment of the present disclosure, drive the first sleeve 22 to rotate relative to the second sleeve 23 by rotating the adjustment ring 21, and by aligning or staggering the second liquid inlet 221 on the first sleeve 22 with the third liquid inlet 231 on the second sleeve 23 to open or close the third liquid inlet 231 on the second sleeve 23. In this way, the adjusting function of cigarette liquid flow can be conveniently realized. Compared with the conventional electronic cigarette atomizer, it is unnecessary to directly immerse the atomization head 5 in the cigarette liquid, and the atomization head 5 and cigarette liquid can be separated or conducted through cooperation of the first sleeve 22 and the second sleeve 23, so that the user can easily control the cigarette liquid and do not need to disassemble the atomizer. In addition, when the two liquid inlets are conductively communicated with each other, the adjustment ring 21 cannot be taken down to carry out injection; and only when the two liquid inlets are completely staggered, the clamping piece 225 is blocked by the connecting arm 4182, and the adjustment ring 21 can be removed by further rotating it, which can effectively prevent liquid leakage.

Third Embodiment

As shown in FIG. 19 to FIG. 26, an atomizer according to the present disclosure includes a base assembly 3, a liquid adjustment assembly 2, a liquid injection assembly 4, an atomization head 5 and a liquid storage tube 1. The liquid injection assembly 4 can be arranged on one end of the liquid storage tube 1 in a rotating manner, one end of the liquid adjustment assembly 2 is connected to one end of the liquid injection tube 1 relative to the liquid injection assembly 4, and the other end is connected to the base assembly 3.

The base assembly 3 comprises a base 31 and a thread ring 37. The thread ring 37 is screwed to one end of the base 31, and one end of the atomization head 5 passes through the thread ring 37 and is installed in the inner chamber of the base 31.

The liquid adjustment assembly 2 comprises an inner sleeve 24 and a second sleeve 23. The inner sleeve 24 is arranged on the outer periphery of the atomization head 5 in a sleeving manner. The inner sleeve 24 has a convex shape, and the inner sleeve 24 comprises a first sleeve 22 set on the upper end and an adjustment ring 21 set at the lower end. The side wall of the first sleeve 22 is formed with a second liquid inlet 221, the step face, connecting the adjustment ring 21 and the first sleeve 22, is formed with a stop through hole 212, and the adjustment ring 21 forms part of the outline of the atomizer. The second sleeve 23 is arranged on the outer periphery of the first sleeve 22 in a sleeving manner and has an end passing through the stop through hole 212 and in interference fit with the thread ring 37. The liquid storage tube 1 is sleeved on the outer periphery of the second sleeve 23. The second sleeve 23 is formed with a third liquid inlet 231 corresponding to the second liquid inlet 221, is capable of connecting to the third liquid inlet 231 of the liquid storage tube 1, and has a clamping piece 225 passing through the stop through hole 212 and in interference fit with the thread ring 37. The atomization head 5 is formed with a first liquid inlet 51 corresponding to the second liquid inlet 221. When the second liquid inlet 221 is communicated with the third liquid inlet 231, the cigarette liquid stored in the liquid storage tube 1 flows out and then flows into the atomization head 5 through the first liquid inlet 51.

When adjusting the cigarette liquid, the second liquid inlet 221 is driven to rotate by rotating the adjustment ring 21, and the relative position of the second liquid inlet 221 and the third liquid inlet 231 is adjusted so that the second liquid inlet 221 is communicated with or staggered from the third liquid inlet 231. In this way, the flow of the cigarette liquid intake can be adjusted to achieve the downward injection of the cigarette liquid.

The liquid injection assembly 4 includes a liquid injection part 41, an upper cover 42 and a rotating shaft 43. One end of the liquid injection part 41 is connected to the liquid storage tube 1, and the other end face of the liquid injection part 41 is formed with a first liquid injection hole 4191, a first smoke outlet 4192, and a first shaft hole 4193. The first liquid injection hole 4191 is connected to the liquid storage tube 1. The first smoke outlet 4192 is formed at the center of the end face of the liquid injection part 41 and is connected to the atomization head 5 through the liquid adjustment assembly 2. The first shaft hole 4193 is formed on the periphery of the liquid injection part 41. The upper cover 42 comprises a second smoke outlet 425 corresponding to the first smoke outlet 4192 and a second shaft hole 426 corresponding to the first shaft hole 417. One end of the rotating shaft 43 is set in the first shaft hole 4193, the other end of the rotating shaft 43 is set in the second shaft hole 426, and the upper cover 42 is capable of rotating around the rotating shaft 43 relative to the liquid injection part 41 to cover or open the first injection hole 4191.

The liquid injection assembly 4 further includes a sealing part 44 set between the liquid injection part 41 and the upper cover 42. The sealing part 44 is embedded in an end of the liquid injection part 41 facing the upper cover 42 to prevent the cigarette liquid from being exposed through the gap between the liquid injection part 41 and the upper cover 42. The sealing part 44 comprises a second liquid injection hole 441 aligned with the first liquid injection hole 415 and a third smoke outlet 442 aligned with the first smoke outlet 416.

The liquid injection assembly 4 further comprises a first clamping part 4194 set on a circumference of one end of the liquid injection part 41 facing the upper cap 42 and a second clamping part 427 set on a circumference of one end of the upper cap 42 corresponding to the first clamping part 4194. When the upper cover 42 covers the liquid injection part 41, the first clamping part 4194 and the second positioning part 427 are engaged with each other to prevent the upper cover 42 from being opened accidentally.

The inner sleeve 24 is rotated so that the second liquid inlet 221 on the inner sleeve 24 is completely staggered from the third liquid inlet 231 on the second sleeve 23, and the cover 42 is rotated to open the upper cover 42 to expose both the first liquid injection hole 4191 and the second liquid injection hole 441 aligned with each other. So that liquid injection can be realized. After injection of the cigarette liquid, the upper cover 42 is rotated to be closed to achieve upward injection of the cigarette liquid.

Figure 27:
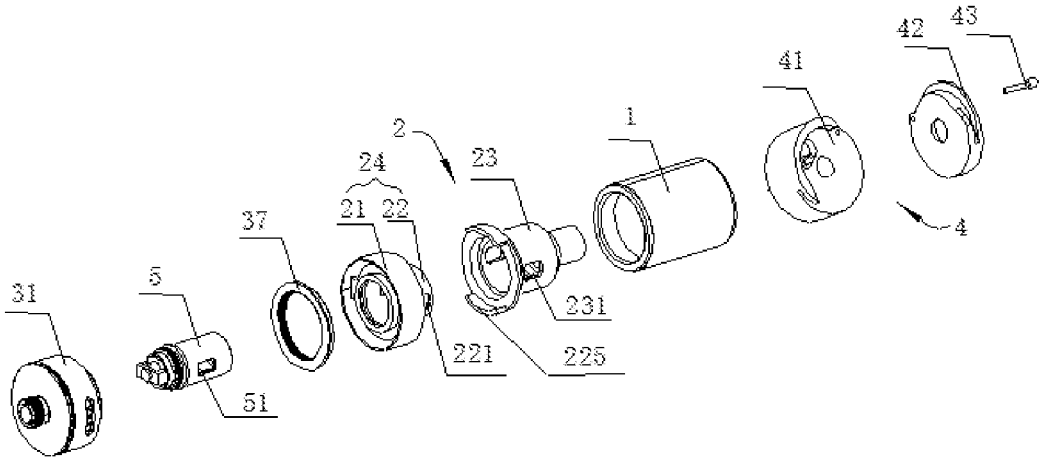
FIG. 27 is an exploded view of a fourth preferred embodiment of the present disclosure.

Rotating the inner sleeve 24 to adjust the liquid of the atomizer, and rotating the inner sleeve 24 and the upper cover 42 to realize liquid injection of the atomizer Fourth Embodiment As shown in FIG. 27, the other structure of the fourth embodiment of the present disclosure is the same as that of the third embodiment, and the difference from the third embodiment is that both the liquid injection part 41 and the upper cover 42 are ceramic pieces, so that sealing is enabled, with sealing part 44 omitted. When an upward liquid injection operation is performed, the inner sleeve 24 is rotated so that the second liquid inlet 221 on the inner sleeve 24 is completely staggered from the third liquid inlet 231 on the second sleeve 23, and then the upper cover 42 is opened by rotating, and first liquid injection hole 4191 is exposed to achieve liquid injection. After injection of the cigarette liquid, the upper cover 42 is closed by rotating it.

Fifth Embodiment

The present disclosure also provides an electronic cigarette, comprising the atomizer according to the third embodiment or the fourth embodiment.

The atomizer of the present disclosure comprises an inner sleeve 24, a second sleeve 23 and an upper cover 42. Wherein, the inner sleeve 21 comprises a second liquid inlet 221, and the second sleeve 23 comprises a third liquid inlet 231. During liquid injection, the inner sleeve 24 is rotated to make the second liquid inlet 221 completely stagger from the third liquid inlet 231, and then the cover 42 is opened by rotating to expose the first liquid injection hole 4191 for liquid injection. The operation is simple, and it is unnecessary to remove the upper cover 42 during liquid injection. In case of liquid adjustment, the lower end of the inner sleeve 24 is rotated, that is, the adjustment ring 21 drives the second liquid inlet 221 to rotate and to adjust the relative positions of the second liquid inlet 221 and the third liquid inlet 231 so that the second liquid inlet 221 and the third liquid inlet 231 is communicated or staggered, the flow of the entering cigarette liquid can be adjusted, and downward liquid adjusted can be enabled. Flow of the cigarette liquid can be adjusted to achieve the downward liquid adjusting operation.

Any combination of the various embodiments of the present disclosure should be regarded as the disclosure of the present disclosure as long as it does not depart from the idea of the present disclosure. Various simple modifications to the technical solutions are within the scope of the technical concept of the present disclosure. Any combination of different embodiments that do not depart from the idea created by the present disclosure should be included within the protection scope of the present disclosure.

What is claimed is:

1. An atomizer, comprising a liquid storage tube, a liquid adjustment assembly and an atomization head, wherein the liquid adjustment assembly comprises an adjustment ring and a first sleeve, the first sleeve is sleeved on an outer periphery of the atomization head, the liquid storage tube is sleeved on an outer periphery of the first sleeve, and the adjustment ring is exposed outside the liquid storage tube, the adjustment ring and the liquid storage tube together form an outline of the atomizer, the atomization head is formed with a first liquid inlet, and the first sleeve is formed with a second liquid inlet, the adjustment ring and the atomization head are relatively fixedly connected, so that the first liquid inlet is communicated with/staggered from the second liquid inlet by rotating the adjustment ring; or the adjustment ring and the first sleeve are relatively fixedly connected, so that the second liquid inlet is communicated with/staggered from the first liquid inlet by rotating the adjustment ring.

2. The atomizer according to claim 1, wherein the adjustment ring is provided with one or more stop through holes, and the adjustment ring and the first sleeve or the atomization head are relatively fixedly connected after each of the stop through holes correspondingly passes through a clamping piece, or the first sleeve is formed with one or more clamping pieces, and after each of the clamping pieces correspondingly passes through one of the stop through holes, the first sleeve and the adjustment ring are relatively fixedly connected.

3. The atomizer according to claim 2, wherein the liquid adjustment assembly further comprises a second sleeve, the second sleeve is sleeved between the first sleeve and the atomization head, or sleeved between the first sleeve and the liquid storage tube, the second sleeve is formed with a third liquid inlet, the adjustment ring and the second liquid inlet are relatively fixedly connected, and the second liquid inlet is communicated with/staggered from the third liquid inlet by rotating the adjustment ring.

4. The atomizer according to claim 1, wherein the outer periphery of the atomization head is flanged with a chuck, and a clamping groove is correspondingly formed on the adjustment ring, the chuck is clamped into the clamping groove so that the atomization head and the adjustment ring are relatively fixedly connected.

5. The atomizer according to claim 2, wherein the first sleeve comprises a main body plate as well as a connecting end and a liquid storage end which are oppositely formed on plate surfaces of the main body plate at its two sides, the liquid storage end is sleeved on the outer periphery of the atomization head, the second liquid inlet is formed on a peripheral wall of the liquid storage end, the liquid storage tube is sleeved on an outer periphery of the liquid storage end, a space for storing cigarette liquid is formed between an inner peripheral face of the liquid storage tube and an outer peripheral face of the liquid storage end, the connecting end comprises the one or more clamping pieces, and the stop through holes with the number equal to that of the clamping pieces are correspondingly formed on the adjustment ring.

6. The atomizer according to claim 5, wherein the atomizer further comprises a liquid injection assembly, the liquid injection assembly comprises a liquid injection part and an upper cover, the liquid injection part is installed on an end of the liquid storage tube opposite to the adjustment ring, the liquid injection part is connected to an end of the liquid storage end away from the main body plate, the liquid injection part is formed with a liquid injection hole communicated with the space for storing cigarette liquid, the upper cover covers the liquid injection part, the upper cover is formed with a smoke outlet, and the smoke outlet, the liquid storage end and the inner chamber of the atomization head are communicated to form a smoke channel.

7. The atomizer according to claim 1, further comprising a base assembly, wherein the base assembly comprises a base, an air adjustment inner ring, an air adjustment ring, a contact electrode and an insulation ring, the air adjustment inner ring is sleeved on an outer periphery of the base, the air adjustment ring is sleeved on an outer periphery of the air adjustment inner ring, the contact electrode is installed in the base, the insulation ring is sleeved on an outer periphery of the contact electrode, the contact electrode is conductively connected with the atomization head, the air adjustment inner ring is formed with a first air inlet, and the air adjustment ring is formed with a second inlet, and the second air inlet is communicated with/staggered from the first air inlet by rotating the air adjustment ring.

8. The atomizer according to claim 3, further comprising a liquid injection part, wherein the liquid injection assembly comprises a liquid injection part, the liquid injection part is installed on a top end of the liquid storage tube, a top end of the first sleeve is formed with the one or more clamping pieces, the liquid injection part is correspondingly formed with the stop through holes with the number equal to the number of the clamping pieces, and the clamping pieces and the adjustment ring are relatively fixedly connected after passing through the corresponding stop through holes.

9. The atomizer according to claim 8, wherein the second sleeve is sleeved between the first sleeve and the atomization head, a top end of the second sleeve and the liquid injection part are fixedly connected, a space between the liquid storage tube and the first sleeve is a liquid storage chamber used for holding cigarette liquid, and the stop through holes are communicated with the liquid storage chamber.

10. The atomizer according to claim 9, wherein the liquid injection part comprises a tube body and a stop connecting body connected to one end of the tube body, the tube body is provided with a peripheral edge opposite to an outer periphery of one end of the stop connecting body, the stop connecting body comprises a connecting tube and a connecting baseplate which integrally carries the connecting tube, the connecting baseplate comprises a carrying plate part and one or more connecting arms extending from an outer periphery of the carrying plate part, and the carrying plate is used for connecting and carrying the connecting tube, the at least one connecting arm is connected to an inner peripheral wall of the tube body, and correspondingly, a stop connecting hole is formed in the tube body, and the peripheral edge is abutted against the top end of the liquid storage tube.

11. The atomizer according to claim 9, wherein the adjustment ring is formed with a smoke outlet which is connected to the atomization head through the second sleeve.

12. The atomizer according to claim 9, wherein the atomizer further comprises a base assembly, wherein the base assembly comprises a base, a base connector, an air adjustment inner ring, an air adjustment ring, a contact electrode and an insulation ring, the atomization head is mounted on the base, a bottom end of the second sleeve is detachably connected with the base, the base connector is connected to the base, the air adjustment inner ring is fixed at a bottom end of the base connector, the air adjustment ring is sleeved on the air adjustment inner ring, the insulation ring is sleeved on the contact electrode, the insulation ring and the contact electrode are embedded in the air adjustment inner ring and set close to a bottom end of the air adjustment inner ring, the contact electrode is conductively connected to the atomization head, the air adjustment inner ring is formed with a first air inlet, the air adjustment ring is formed with a second air inlet, and the second air inlet is communicated with/staggered from the first inlet by rotating the air adjustment ring.

13. The atomizer according to claim 3, wherein the first sleeve is set on an upper end of the adjustment ring, the first sleeve and the adjustment ring are integrally molded to form an inner sleeve, and the one or more stop through holes are formed on a step surface connecting the adjustment ring and the first sleeve, the second sleeve is correspondingly provided with the clamping pieces with the number equal to the number of the stop through holes, the first sleeve is sleeved on the outer periphery of the atomization head, the second sleeve is sleeved on the outer periphery of the first sleeve, and the clamping pieces pass through the corresponding stop through holes.

14. The atomizer according to claim 13, further comprising a liquid injection assembly, wherein the liquid injection assembly comprises a liquid injection part, an upper cover and a rotating shaft, one end of the liquid injection part is connected to a top end of the liquid storage tube, and an end face of the other end of the liquid injection part is formed with a first liquid injection hole, a first smoke outlet, and a first shaft hole, the first liquid injection hole is communicated with the liquid storage tube, and the upper cover is formed with a second shaft hole corresponding to the first shaft hole and a second smoke outlet corresponding to the first smoke outlet, one end of the rotating shaft is set in the first shaft hole, and the other end of the rotating shaft is set in the second shaft hole, so that the upper cover can rotate relative to the liquid injection part around the rotating shaft to cover or open the first liquid injection hole.

15. The atomizer according to claim 14, wherein the liquid injection assembly further comprises a sealing part set between the liquid injection part and the upper cover, and the sealing part is embedded in an end of the liquid injection part facing the upper cover.

16. The atomizer according to claim 14, wherein the liquid injection part and the upper cover are both ceramic pieces.

17. The atomizer according to claim 14, wherein a first clamping part is set on the end of the liquid injection part facing the upper cover, and a second clamping part corresponding to the first clamping part is set on the upper cover, and when the upper cover covers the liquid injection part, the first clamping part and the second clamping part are engaged with each other.

18. The atomizer according to claim 13, further comprising a base assembly, wherein the base assembly comprises a base and a thread ring, the thread ring is threaded connected to one end of the base, and one end of the atomization head is mounted in an inner chamber of the base after passing through the thread ring.

19. An electronic cigarette, comprising the atomizer according to claim 1.

* * * * *